US005705978A

United States Patent [19]

Frick et al.

[11] Patent Number: 5,705,978

[45] Date of Patent: Jan. 6, 1998

[54] PROCESS CONTROL TRANSMITTER

[75] Inventors: Roger L. Frick, Hackensack; Ahmed H. Tewfik, Edina; John P. Schulte, Eden Prairie, all of Minn.

[73] Assignee: Rosemount Inc., Eden Prairie, Minn.

[21] Appl. No.: 536,766

[22] Filed: Sep. 29, 1995

[51] Int. Cl.[6] ..... G08B 29/00

[52] U.S. Cl. ..... 340/511; 340/517; 340/522; 340/521; 340/506; 364/571.02; 364/571.03

[58] Field of Search ..... 340/517, 521, 340/522, 505, 506, 511, 518, 584; 364/571.02, 571.03, 557

[56] References Cited

U.S. PATENT DOCUMENTS

| | | | |
|---|---|---|---|
| 4,227,419 | 10/1980 | Park | 73/724 |
| 4,322,977 | 4/1982 | Sell et al. | 73/701 |
| 4,363,099 | 12/1982 | Srinivasan et al. | 364/484 |
| 4,372,164 | 2/1983 | Brown et al. | 73/704 |
| 4,398,426 | 8/1983 | Park et al. | 73/724 |
| 4,446,447 | 5/1984 | McNamara | 331/42 |
| 4,449,409 | 5/1984 | Antonazzi | 73/724 |
| 4,457,179 | 7/1984 | Antonazzi et al. | 73/701 |
| 4,532,809 | 8/1985 | Antonazzi et al. | 73/701 |
| 4,546,344 | 10/1985 | Guscott et al. | 340/501 |
| 4,592,002 | 5/1986 | Bozarth, Jr. et al. | 364/571 |
| 4,598,381 | 7/1986 | Cucci | 364/558 |
| 4,618,856 | 10/1986 | Antonazzi | 340/626 |
| 4,644,798 | 2/1987 | Tamura et al. | 73/708 |
| 4,724,709 | 2/1988 | Antonazzi, Sr. et al. | 73/701 |
| 4,804,958 | 2/1989 | Longsdorf | 340/870.07 |
| 4,851,841 | 7/1989 | Sooch | 341/143 |
| 4,876,892 | 10/1989 | Arabia et al. | 73/718 |
| 4,890,056 | 12/1989 | Peters et al. | 324/83 |
| 4,896,100 | 1/1990 | Buck | 324/678 |
| 5,028,876 | 7/1991 | Cadwell | 324/678 |
| 5,051,743 | 9/1991 | Orszulak | 340/870.04 |
| 5,083,091 | 1/1992 | Frick et al. | 324/678 |
| 5,274,374 | 12/1993 | Powell et al. | 341/143 |
| 5,486,811 | 1/1996 | Wehrle et al. | 340/522 |
| 5,578,993 | 11/1996 | Sitabkhan et al. | 340/614 |

FOREIGN PATENT DOCUMENTS

| | | |
|---|---|---|
| 58-66030 | 4/1983 | Japan . |
| 6-314962 | 11/1994 | Japan . |
| 7-74767 | 8/1995 | Japan . |

OTHER PUBLICATIONS

"The Digitisation of Field Instruments," by Willem Van Der Bijl, *Journal A*, vol. 32, No. 3, pp. 62–65, (1991).

"The Design of Sigma–Delta Modulation Analog–to–Digital Coverters," *IEEE Journal of Solid–State Circuits*, by Bernhard Boser and Bruce Wooley, vol. 23, No. 6, Dec. 1988 pp. 1299–1308.

"Standard Research Systems," *Scientific & Engineering Instruments*, 1994–1995, pp. 66–71, 88–89, 3–3 and 3–5.

*Primary Examiner*—Jeffery Hofsass
*Assistant Examiner*—Daryl C. Pope
*Attorney, Agent, or Firm*—Westman, Champlin & Kelly, P.A.

[57] ABSTRACT

A transmitter in a process control system includes input/output circuitry for coupling to a process control loop. A first sensor having a first impedance is responsive to a first sensed parameter. A second sensor having a second impedance is responsive to a sensed parameter. First and second excitation signals are applied to the first and second sensors. A summing node sums the outputs of the first and second sensors. An analog to digital converter provides a digital output representative of the summed signals. Digital signal processing circuitry coupled to the analog to digital converter provides an output related to the outputs of the first and second sensors to the input/output circuitry for transmission over the process control loop.

20 Claims, 4 Drawing Sheets

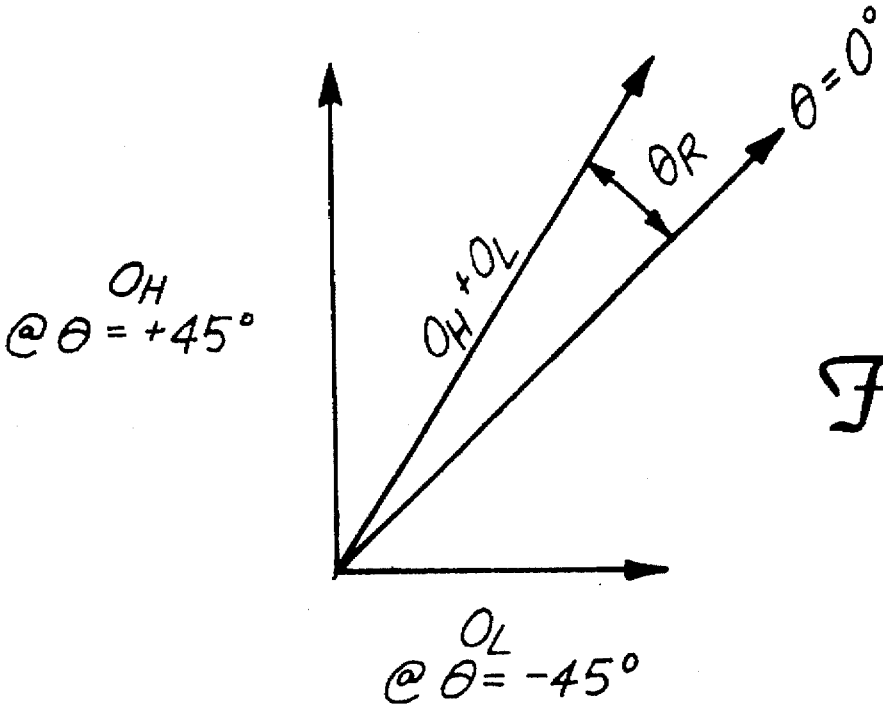
Fig 3
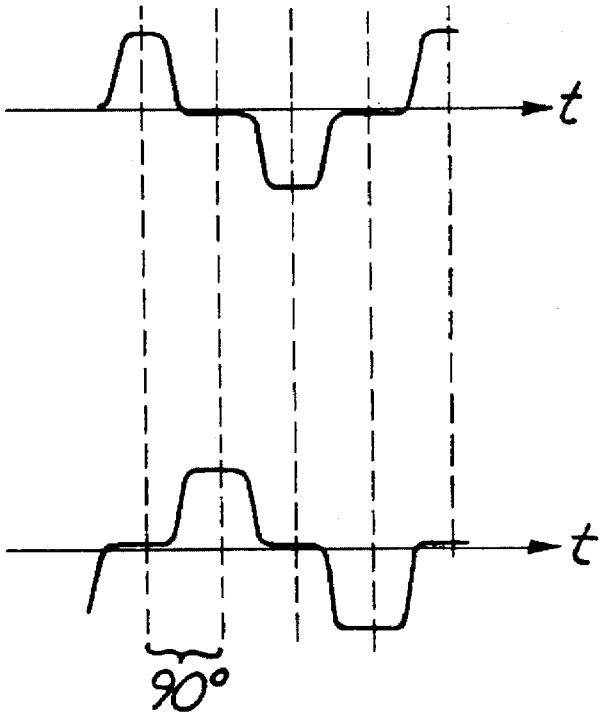
Fig. 5A
Fig. 5B

PROCESS CONTROL TRANSMITTER

BACKGROUND OF THE INVENTION

The present invention relates to a process control transmitter having an analog to digital converter providing a digital representation of a sensor input signal. More specifically, the present invention relates to a process control transmitter having a sensor producing a sensor signal representative of a sensed parameter which is converted into digital representation of the sensor signal. The sensor signal is representative of a sensed parameter.

Transmitters in the process control industry typically communicate with a controller over the same two wires from which they receive power. A transmitter receives commands from a controller and sends output signals representative of a sensed physical parameter back to the controller. A commonly used method is a current loop where the sensed parameter is represented by a current varying in magnitude between 4 and 20 mA.

The transmitter includes a sensor for sensing a physical parameter related to a process. The sensor outputs an analog signal which is representative of one of several variables, depending on the nature of the process to be controlled. These variables include, for example, pressure, temperature, flow, pH, turbidity and gas concentration. Some variables have a very large dynamic range such as flow rate where the signal amplitude of the sensor output changes by a factor of 10,000.

An analog to digital converter in the transmitter converts the analog sensor signal to a digital representation of the sensed physical parameter for subsequent analysis in the transmitter or for transmission to a remote location. A microprocessor typically compensates the sensed and digitized signal and an output circuit in the transmitter sends an output representative of the compensated physical parameter to the remote location over the two wire loop. The physical parameter is typically updated only a few times per second, depending on the nature of the process to be controlled, and the analog to digital converter is typically required to have 16 bits of resolution and a low sensitivity to noise.

Charge balance converters are used in transmitters to provide analog to digital conversions. One such converter is described in U.S. Pat. No. 5,083,091 entitled "Charged Balanced Feedback Measurement Circuit" which issued Jan. 21, 1992 to Frick et al. Sensors in such transmitters provide a impedance which varies in response to the process variable. An output from the impedance is converted by the charged balance converter into a digital representation of the impedance. This digital representation can be transmitted across an isolation barrier which isolates the sensor circuitry from the other transmitter circuitry. Charge balance converters are a type of sigma-delta ($\Sigma\Delta$) converter. The output of such a converter is a serial bit stream having a width of 1 bit. This 1 bit wide binary signal contains all of the information necessary to digitally represent the amplitude and frequency of the output signal from the sensor impedance. The serial format of the output is well suited for transmission across the isolation barrier. The sigma-delta converter also provides a high resolution output with a low susceptibility to noise.

SUMMARY OF THE INVENTION

The present invention provides a technique for multiplexing more than one signal onto an analog to digital converter in a transmitter for a process control system. These signals may be the outputs from a process variable sensor, a reference, or other sensors used for compensation. In general, these signals are referred to as sensed parameters. The transmitter includes input/output circuitry for coupling to a process control loop. A first sensor has a first impedance which varies in response to a sensed parameter, for example a process variable of the process. A second sensor has a second impedance which varies in response to another sensed parameter. A first excitation signal is provided to the first sensor and a second excitation signal is provided to the second sensor. Outputs from the first and second sensors are responsive to the first and second excitation signals and sensed parameters. A summing node sums the outputs from the first and second sensors. An analog to digital converter converts the summed signals into a digital format. Digital signal processing circuitry extracts the sensed parameters from the digital output of the analog to digital converter. The digital signal processing circuitry provides an output based upon the sensed parameters, to the input/output circuitry for transmission over the process control loop.

BRIEF DESCRIPTION OF THE DRAWINGS

FIG. 3 is a vector diagram showing outputs for two capacitor sensors.

FIG. 5A is a graph of amplitude versus time of a distorted sinusoidal waveform for use with the present invention.

FIG. 5B is a graph of amplitude versus time for a distorted sinusoidal waveform shifted 90° relative to the waveform of FIG. 5A.

DETAILED DESCRIPTION OF THE PREFERRED EMBODIMENTS

Figure 1:
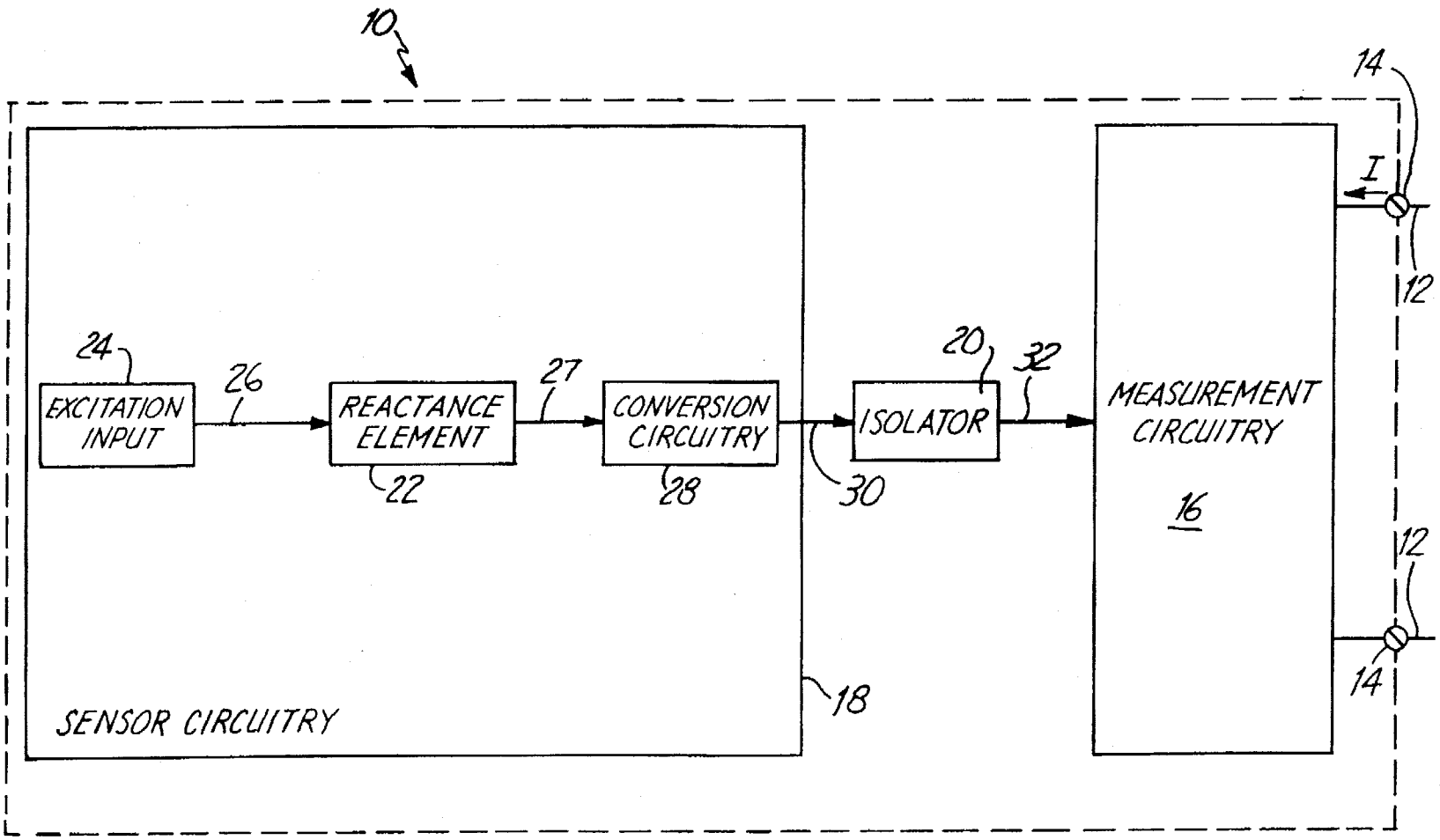
FIG. 1 is a simplified block diagram of a transmitter in accordance with one embodiment of the present invention.

FIG. 1 is a simplified block diagram of a transmitter 10 in accordance with one embodiment of the present invention coupled to process control loop 12 at connection terminals 14. Transmitter 10 includes measurement circuitry 16 and sensor circuitry 18. Measurement circuitry 16 couples to two-wire loop 12 and is used for sending and receiving information on loop 12. Measurement circuitry 16 also includes circuitry for providing a power supply output for transmitter 10 which is generated from loop current I flowing through loop 12. In one embodiment, measurement circuitry 16 and sensor circuitry 18 are carried in separate compartments in transmitter 12 and electrically isolated by isolator 20. Isolator 20 is an isolation barrier required for electrically grounded sensors. Sensor circuitry 18 includes a sensor (shown as impedance) 22 which has a plurality of variable impedances responsive to sensed parameters. As used herein, sensed parameters include process variables representative of a process (i.e. temperature, pressure, differential pressure, flow, strain, pH, etc.), reference levels and compensation variables such as sensor temperature used to compensate other sensed variables. Excitation signals are provided to impedance 22 by excitation input circuitry 24 over the electrical connection 26. Other excitation signals could include optical, mechanical, magnetic, etc. Impedance 22 produces output signals on output 27 in response to the excitation input signals from excitation input 24. The output signals are variable based upon the sensed parameters.

In the present invention, impedance element 22 includes one or more separate variable impedances coupled to different excitation signals from excitation input 24. Each individual impedance provides an output signal to conversion circuitry 28 which combines and digitizes the signals into a single digital output stream. Conversion circuitry 28 provides an output on output line 30 to isolator 20 which electrically isolates conversion circuitry 28. Isolator 20 reduces ground loop noise in measurement of the sensed parameters. Isolator 20 provides an isolated output on line 32 to measurement circuitry 16. Measurement circuitry 16 transmits a representation of the digitized signal received from conversion circuitry 28 on loop 12. In one embodiment, this representation is an analog current level or a digital signal. In a preferred embodiment, measurement circuitry 16 receives the digital signal and recovers the individual signals generated by the separate impedances in impedance element 22. Lines 26, 27, 30 and 32 may comprises any suitable transmission medium including electrical conductors, fiber optics cables, pressure passage ways or other coupling means.

Figure 2:
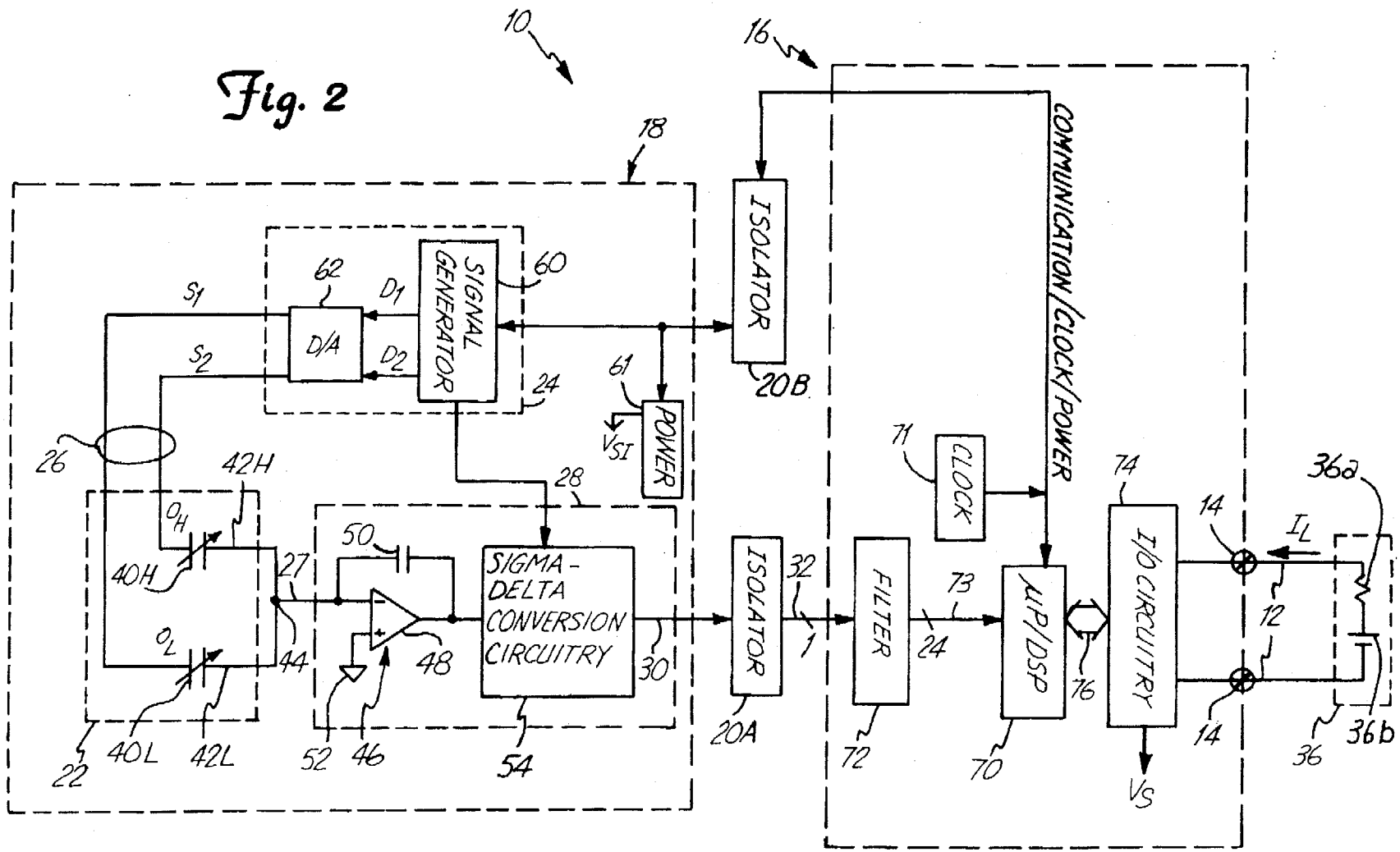
FIG. 2 is a more detailed block diagram of the transmitter of FIG. 1 showing signal conversion circuitry in accordance with one embodiment.

FIG. 2 is a more detailed block diagram of transmitter 10 which shows transmitter 10 coupled to control room circuitry 36 over two-wire process control loop 12. Control room circuitry 36 is modeled as a resistor 36A and voltage source 36B. Current $I_L$ flows from loop 12 through transmitter 10.

In the embodiment shown in FIG. 2, sensor 22 includes capacitor pressure sensors 40H and 40L having capacitance $C_H$ and $C_L$ which respond to pressures $P_H$ and $P_L$, respectively. The capacitance $C_H$ and $C_L$ are representative of a sensed pressure of a process, for example. Capacitor 40L receives excitation input signal $S_1$ over input lines 26 from input circuitry 24. Capacitor 40H receives excitation input signal $S_2$ over input lines 26 from input circuitry 24. Capacitors 40H and 40L responsively generate output signals $O_H$ and $O_L$ on output lines 42H and 42L, respectively. Output lines 42H and 42L are coupled together at a summing node 44 which couples to conversion circuitry 28 over line 27.

Conversion circuitry 28 includes high impedance input amplifier 46. In one embodiment, amplifier 46 comprises an operational amplifier 48 having negative feedback from an output terminal to an inverting input terminal through capacitor 50. The non-inverting input of amplifier 48 is coupled to a chassis or earth electrical ground 52. The inverting input of operational amplifier 48 connects to summing node 44 through line 27. The output from amplifier 46 is provided to sigma-delta conversion circuitry 54 which operates in accordance with well known sigma-delta conversion techniques. For example, the article entitled "The Design of Sigma-delta Modulation Analog-to-Digital Converters", Bernhard E. Boser et al., IEEE JOURNAL OF SOLID-STATE CIRCUITS, Vol 23, No. 6, December 1988, pgs. 1298–1308 describes design of sigma-delta converters. Sigma-delta conversion circuitry 54 should be constructed to have a sufficiently high sampling rate and resolution for the particular sensor used for sensor 22 across the dynamic range of the sensor output. Sigma-delta conversion circuitry 54 provides a bit stream output having a width of a single bit on line 30. This digital output contains all of the information necessary to digitally represent the amplitude phase and frequency of the input signal provided by amplifier 46.

Excitation signals $S_1$ and $S_2$ from excitation input circuitry 24 may be generated using any appropriate technique. In the embodiment shown, signals $S_1$ and $S_2$ are generated using a digital signal generator 60 which provides digital signal outputs $D_1$ and $D_2$ to a digital to analog converter 62. Digital to analog converter 62 responsively generates analog signals $S_1$ and $S_2$. Generator 60 is coupled to conversion circuitry 54 and provides clock signal to circuitry 54. In one preferred embodiment, signals $S_1$ and $S_2$ are sinusoidal signals having a frequency of about 10 Hz to about 100 $H_z$ and a relative phase shift of 90°. In one embodiment, the output of signal generator 60 is adjusted to compensate for manufacturing process variations in capacitors 40H and 40L. For example, phase, frequency, waveshape and amplitude can be adjusted. Signal generator 60 receives clock and communication signals through isolator 20B. The clock signal is also used by power supply 61 to generate an isolated supply voltage $V_{SI}$ which powers circuitry 18.

Measurement circuitry 16 includes a microprocessor/digital signal processor 70 which receives the output from sigma-delta conversion circuitry 54 through isolator 20A and decimating filter 72. In one embodiment, the output of filter 72 carried on data bus 73 is 16 to 24 bits in width having 24 bits of resolution. Decimating filter 72 reformats the single bit wide data stream on line 32 having a lower data rate digital into a byte-wide data stream for use by microprocessor 70. Microprocessor/digital signal processing circuitry 70 also receives an input from input circuitry 24 which provides a reference signal relative to excitation input signals $S_1$ and $S_2$. Microprocessor 70 processes the digitized signal and extracts the signals generated from each of the individual capacitors 40H and 40L. Typically, the two different signals are extracted using information indicating the phase, frequency and amplitude of excitation signals $D_1$ and $D_2$. Microprocessor 70 calculates absolute pressure sensed by capacitor 40H, absolute pressure sensed by capacitor 40L and differential pressure. Microprocessor 70 provides this information to input/output (I/O) circuitry 74 over data bus 76. I/O circuitry 74 couples to processor control loop 12 through terminals 14 and receives loop current $I_L$. I/O circuitry 74 generates a power supply voltage $V_S$ for powering circuitry 16 transmitter 10 from current $I_L$. I/O circuitry 74 transmits information related to sensed pressure to control room 36 over loop 12. Transmission of this information is through control of current $I_L$, by digital transmission or by any suitable transmission technique.

FIG. 3 is a vector diagram signals $O_H$, $O_L$, and $O_H+O_L$. FIG. 3 shows the combination of $O_H+O_L$ generated by the analog summation at summing node 44. The individual signals $O_H$ and $O_L$ can be recovered by determining amplitude at +45° and −45°, respectively. This allows the pressures $P_H$ and $P_L$ sensed by capacitors $40_H$ and $40_L$ to be determined. The phase shift of the combined $O_H+O_L$ signal, $\theta_R$, can be measured in the time domain in order to determine $P_H-P_L$ with maximum accuracy and resolution.

The technique shown in FIG. 2 is useful for transmitting a number of different channels of information across a single isolator in a transmitter. For example, the sensor circuitry of a transmitter may measure any sensed parameter such as differential pressure, absolute pressures, change in temperature, absolute temperature and sensor temperature. Additional parameters are used to compensate differential pressure and absolute pressure readings. In the present invention, capacitor sensors may be employed for all channels of information and excited using signals of differing frequencies, phases, amplitudes, or wave shapes. Outputs of these capacitor sensors are summed in the analog domain and digitized using an analog to digital converter. The digital signal is then transmitter across the isolator to the measurement circuitry where the individual signals are identified using digital signal processing. These signals may be compensated and used in computations prior to transmission over the process control loop. The digital signal processing computes the amplitude and phase of each frequency component. For example, digital filters may be employed to separate the signals. The outputs can be further processed to measure amplitude and phase. A discrete fourier transform DFT implemented with a fast fourier transform FFT may be used to provide a spectrum of the signal which is examined to determine the magnitude of the individual signals at desired frequencies. In one embodiment, analog filters are used to recover the individual signals, however, analog filters may have limited resolution.

In one embodiment, excitation signals are signals of different frequencies generated relative to the frequency of a system clock. Digital signal processing circuitry uses the clock signal as a reference to identify signals generated in response to the different excitation signals. In other embodiments, differing phases or amplitudes of the excitation signals may be used.

Figure 4:
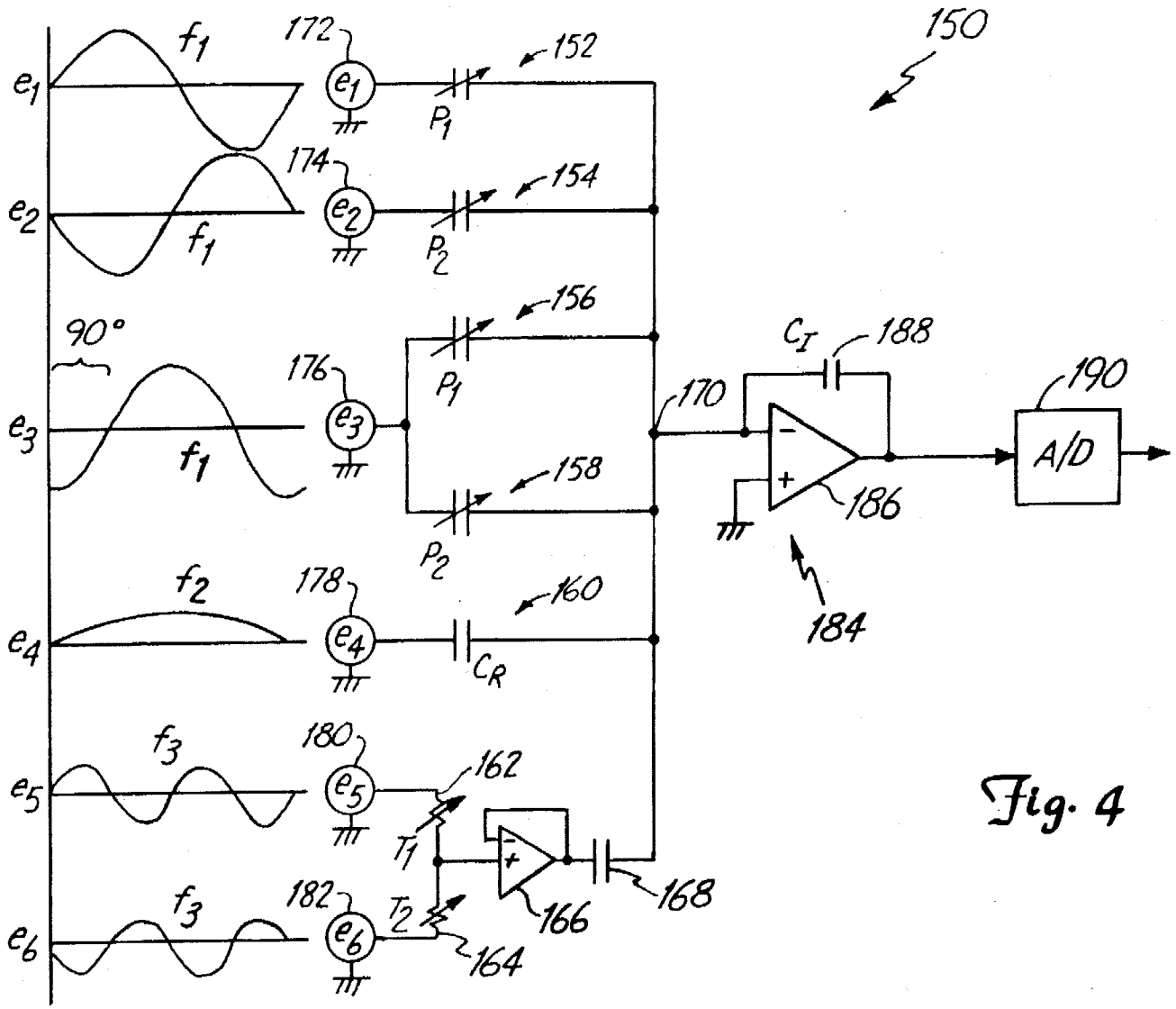
FIG. 4 is a simplified schematic diagram in accordance with another embodiment of the invention.

FIG. 4 is a simplified electrical diagram of sensor circuitry 150 in accordance with another embodiment. Sensor circuitry 150 includes capacitor sensors 152, 154, 156, 158 and 160. Capacitor sensor 152 measures pressure $P_1$, capacitor sensor 154 measures pressure $P_2$ and the combination of sensors 156 and 158 measure pressures $P_1$–$P_2$. Capacitor sensor 180 provides a calibration capacitance which is used to calibrate the system and measure system errors. Variable resistances 162 and 164 vary in response to temperatures $T_1$ and $T_2$ and are coupled to the non-inverting input of operational amplifier 166 which is connected with negative feedback and provides a buffer. The output of amplifier 166 is connected to capacitor 168. Variable impedances 152 through 164 are connected to signal sources 172, 174, 176, 178, 180 and 182 which provide excitation signals $e_1$, $e_2$, $e_3$, $e_4$, $e_5$ and $e_6$, respectively. FIG. 4 also shows the waveforms of signals $e_1$ through $e_6$ adjacent each signal generator 172 through 182. Signal $e_1$ has a frequency of $f_1$ and 0° of phase shift. Signals $e_2$ and $e_3$ are also at a frequency $f_1$ but shifted 180° and 90°, respectively, in phase. Signal $e_2$ is at a second frequency $f_2$ which is shown in the example as being equal to $f_1/2$. Signals $e_5$ and $e_6$ are shown at a third frequency $f_3$ which is shown as $2\times f_1$. Signal $e_6$ is shifted 180° relative to $e_5$. In embodiments in which the excitation signals are 180° apart, signal processing circuitry will not be able to isolate the individual excitation signals.

Outputs from capacitors 152 through 160 and 168 are connected to summing node 170 at the inverting input of amplifier 184. Amplifier 184 is shown as operational amplifier 186 having negative feedback through an integrating capacitor 188 given as:

$$V_{OUT} = \frac{\Sigma e_n c_n}{C_I} \qquad \text{Eq. 1}$$

where:

$e_n$=excitation signals from 172–182;

$c_n$=capacitor values 152–160 and 168; and $C_I$=capacitor value of 188.

Amplifier 184 provides an output to analog to digital converter 190 which is representative of a summation of the outputs from capacitors 152 through 160 and 168.

Temperature is sensed by resistors 162 and 164 which vary in resistance in response to temperatures $T_1$ and $T_2$. Resistors 162 and 164 selectively weight signals $e_5$ and $e_6$ in a mixing operation and provide the mixed signals to capacitor 168 through amplifier 166. Digital signal processing circuitry (not shown in FIG. 4) identifies outputs from capacitors 152 through 160 and 168 and determines pressures $P_1$, $P_2$, $P_1$–$P_2$, reference capacitance $C_R$ and differential temperature $T_1$–$T_2$. All of these are representative of sensed parameters. In one embodiment, the sensed parameter $C_R$ which is representative of a reference capacitance is used to compensate and determine errors in other measurements.

Although the example in FIG. 4 shows sine waves at integral frequency multiples, other non-sinusoidal signals could be used and signals which are non-integral frequency multiples, aperiodic, random or pseudorandom, band limited or any desired combination may be employed. Non-sinusoidal signals could be used to generate linear, non linear or logarithmic phase outputs. Amplitudes, frequency or phase of the excitation signals could be controlled as a function of sensed parameters to generate desired transfer functions. Broadband deterministic or random excitation signals can be used to increase immunity to narrow band interferences. For example, pseudo random sequences can be used as excitation signals. This would be a code division multiplexing system similar to that used in the multiuser communications systems (CDMA).

Determination of the sensed parameter may be through any appropriate signal processing technique. For example, the instantaneous frequency shift associated with a change in phase may be employed to detect change in pressure. This is expressed with the following equations that hold true during the change:

$$f_{OUT} = f_{EX} + K\frac{d\Theta}{dt} \qquad \text{Eq. 2}$$

$$\int(f_{OUT} - f_{EX})dt = K\Theta \qquad \text{Eq. 3}$$

$$\Delta P \propto \Theta = \frac{\int(f_{OUT} - f_{EX})dt}{K} \qquad \text{Eq. 4}$$

Where $f_{EX}$ is the frequency of the excitation signal, $f_{OUT}$ is the output from a capacitor sensor K is a constant and θ is the phase shift. C is a constant of proportionality which converts K·θ into change in pressure.

Distortions to sinusoidal signals may also be employed as excitation signals and used to optimize sensitivity of the sensor circuitry. For example, FIG. 5A shows a distorted sinusoidal signal and FIG. 5B shows the sinusoidal signal of 5A shifted 90° in phase. The distorted sine waves shown in FIGS. 5A and 5B increase the sensitivity of the measurement circuitry in the region of ΔP=0 (i.e. $C_H$=$C_L$). It is also possible to adjust the waveform such that there is a logarithmic relationship in the output signal and the analog to digital converter does not need as large a dynamic range.

It is also possible to use a reference waveform in the measurements. In this embodiment, $C_H$ and $C_L$ are driven with excitation signals which are 180° shifted in phase. A reference capacitor is driven with a waveform shifted 90° relative to either of the waveforms used to drive $C_H$ and $C_L$. The resulting output amplitude is as follows:

$$\text{Amplitude} = \sqrt{(C_H - C_L)^2 + C_R^2} \qquad \text{Eq. 5}$$

Where $C_H$ and $C_L$ are the capacitance values of the high and low pressure sensors and $C_R$ is a reference capacitance. In another embodiment, phase is measured twice per cycle to eliminate 1/f noise and zero offset errors in zero crossing detection. Zero offset errors will add and subtract the same amount of phase shift to the two signals and therefore cancel each other out.

The present invention overcomes a number of problems associated with the prior art. For example, one prior technique uses time multiplexing which increases the possibility of aliasing noise and limits the ability to adjust resolution versus response time of the conversion circuitry. Using multiple analog to digital converters increases power consumption. Further, the converters may interact with in unpredictable ways and complicate isolation of the sensor circuitry. In addition, using two converters to measure a difference signal doubles the error magnitude. The present invention uses a low power technique by utilizing a large portion of the available band width of the analog to digital converter, particularly a sigma-delta converter. Fewer parts are required because only a single converter is utilized. Interactions between various components are minimized and are more predictable. Aliasing is limited because all of the sensed parameters can be monitored at the high sampling frequency of a sigma-delta converter and antialiasing digital filters can be incorporated before the microprocessor samples the sensor output.

Variations on the particular implementation set forth herein are considered within the scope of the invention. For example, any or all of the functions may be implemented in analog or digital circuitry such as signal generation, transmission across an isolator, filtering, signal processing, compensation, transmission, etc. These techniques are well suited for reducing noise during measurements, even if a single sensed parameter is being measured. Further, any appropriate implementation of the various features are considered within the scope of the invention. The generation of the excitation signal may be through other techniques than those disclosed. The particular technique for summing the outputs from the impedance elements may be varied, different types of filters or digital to analog and analog to digital converters may be employed. Any appropriate impedance or any number of elements may be used having an impedance which varies in response to a sensed parameter may be employed. Other techniques for detecting and identifying individual sensor outputs may be used as well as other synchronization or power generation techniques. Signal processing techniques such as fuzzy logic, neural networks, etc. may also be employed. Other signal processing techniques such as lock-in amplifier technology, implemented in either digital or analog technologies may also be employed. Lock-in amplifiers are well suited for identifying and isolating a signal among other signals using a reference signal.

Although the present invention has been described with reference to preferred embodiments, workers skilled in the art will recognize that changes may be made in form and detail without departing from the spirit and scope of the invention.

What is claimed is:

1. A transmitter in a process control system, comprising:

input/output circuitry for coupling to a process control loop;

a first sensor having a first impedance which varies in response to a first sensed parameter;

a second sensor having a second impedance which varies in response to a second sensed parameter;

a first excitation AC signal coupled to the first sensor;

a second excitation AC signal coupled to the second sensor;

a summing node coupled to outputs of the first and second sensors combining the AC outputs of the first and second sensors into a summed output;

an analog to digital converter coupled to the summing node, the analog to digital converter receiving the summed output and providing a digital output representative of the summed output and thus of summed AC outputs from the first and second sensors; and digital signal processing circuitry coupled to the output from the analog to digital converter which processes the digital output and provides an output related to the first and second sensed parameter to the input/output circuitry for transmission over the process control loop.

2. The transmitter of claim 1 wherein the first sensor comprises a capacitor.

3. The transmitter of claim 1 wherein the first sensor is selected from the group consisting of: pressure sensors, differential pressure sensors, absolute pressure sensors, temperature sensors and flow sensors.

4. The transmitter of claim 1 wherein the first and second excitation signals are phase shifted relative to each other.

5. The transmitter of claim 1 wherein the first and second excitation signals are of different frequencies.

6. The transmitter of claim 1 wherein the analog to digital converter comprises a sigma-delta converter.

7. The transmitter of claim 1 including an operational amplifier having an inverting input coupled to the summing node and an output coupled to the analog to digital converter.

8. The transmitter of claim 1 including:

a third sensor having a third impedance which varies in response to a third sensed parameter;

a third excitation signal coupled to the third sensor; and wherein the summing node is coupled to an output of the third sensor, the analog to digital converter provides an output representative of summed outputs from the first, second and third sensors, and the digital signal processing circuitry provides an output related to the first, second and third sensed parameter.

9. The transmitter of claim 1 wherein the first sensed parameter comprises a process variable.

10. The transmitter of claim 1 including an isolator coupling the digital output to the digital signal processing circuitry.

11. The transmitter of claim 1 including:

a digital signal generator generating digital first and second excitation signals; and a digital to analog converter coupled to the first and second sensors converting the digital excitation signals into the first and second excitation signals.

12. The transmitter of claim 1 wherein the first sensor comprises a variable resistor.

13. The transmitter of claim 1 wherein the first excitation signal comprises a distorted sine wave.

14. The transmitter of claim 1 wherein the first and second excitation signals are code division multiplexed.

15. A transmitter in a process control system, comprising:

input/output circuitry coupling to a process control loop for sending information over the loop and receiving power from the loop to power the transmitter;

a sensor having a impedance responsive to a sensed parameter;

a digital signal generator generating a time varying excitation signal;

a digital to analog converter converting the digital excitation signal to an analog excitation signal coupled to the sensor thereby exciting the sensor to cause a sensor output signal;

analog to digital conversion circuitry coupled to the sensor output and responsively providing a digital sensor signal; and digital signal processing circuitry synchronized with the digital signal generator for identifying and measuring the sensor output signal and transmitting an output representative of the sensed parameter over the process control loop using the input/output circuitry.

16. The transmitter of claim 15 including multiple sensors and multiple excitation signals generated by the signal generator.

17. The transmitter of claim 16 wherein the multiple excitation signals have differing phases.

18. The transmitter of claim 16 wherein the sensed parameter comprises a process variable.

19. The transmitter of claim 16 wherein the sensor comprises a variable capacitor.

20. A transmitter in a process control loop comprising:

a plurality of sensors having a plurality of variable impedances responsive to a plurality of sensed parameters;

a plurality of excitation signals applied to each of the plurality of sensors causing a plurality of sensor output signals, the excitation signals generated by signal generating circuitry, each of the excitation signals having different waveforms;

a summed signal representative of a summation of the plurality of sensor output signals;

signal processing circuitry coupled to the summed signal having an output related to the sensed parameters; and output circuitry coupled to the process control loop and the signal processing circuitry transmitting the output related to the sensed parameters over the process control loop.

* * * * *